US011495893B2

(12) United States Patent
Tanaka

(10) Patent No.: US 11,495,893 B2
(45) Date of Patent: Nov. 8, 2022

(54) CONNECTOR

(71) Applicant: Japan Aviation Electronics Industry, Limited, Tokyo (JP)

(72) Inventor: Masashi Tanaka, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/466,147

(22) Filed: Sep. 3, 2021

(65) Prior Publication Data

US 2022/0149543 A1 May 12, 2022

(30) Foreign Application Priority Data

Nov. 9, 2020 (JP) ..... JP2020-186430

(51) Int. Cl.
*H01R 4/2454* (2018.01)
*H01R 13/41* (2006.01)

(52) U.S. Cl.
CPC ..... *H01R 4/2454* (2013.01)

(58) Field of Classification Search
CPC ..... H01R 13/41; H01R 4/02; H01R 4/2433; H01R 11/05
See application file for complete search history.

(56) References Cited

U.S. PATENT DOCUMENTS 6,361,352 B2 * 3/2002 Barrat ..... H01R 4/2466 439/417
7,357,661 B2 4/2008 Yamamoto et al.
2011/0243508 A1 * 10/2011 Koreeda ..... G02B 6/3817 385/78
2012/0037402 A1 * 2/2012 Kawase ..... H01R 13/5829 174/135

FOREIGN PATENT DOCUMENTS

JP S63-23775 U 2/1988
JP 2006-236854 A 9/2006
KR 2018-0136183 A 12/2018
WO 2020/051340 A1 3/2020

OTHER PUBLICATIONS

Extended European Search Report in EP 21195798.0, dated Mar. 4, 2022.

* cited by examiner

*Primary Examiner* — Jean F Duverne
(74) *Attorney, Agent, or Firm* — Collard & Roe, P.C.

(57) ABSTRACT

In a first contact of a connector, an insulation-displacement connection portion has two insulation-displacement blades and has a narrow slit and a wide slit. The insulation-displacement blades are different from each other in position in a first direction and correspond to the narrow slit. The insulation-displacement blades are obliquely intersected with the first direction. The narrow slit and the wide slit extend in the front-rear direction. In the first direction, the insulation-displacement blade is located between the narrow slit 362 and the wide slit 364. In a second direction, a middle of the wide slit 364 is different from a middle of the narrow slit 362 in position. When covered wire is pushed into the narrow slit, it is pressed on the insulation-displacement blades at different timings in order.

6 Claims, 14 Drawing Sheets

CONNECTOR

CROSS REFERENCE TO RELATED APPLICATIONS

This application is based on and claims priority under 35 U.S.C. § 119 to Japanese Patent Application No. JP2020-186430 filed Nov. 9, 2020, the contents of which are incorporated herein in their entirety by reference.

BACKGROUND OF THE INVENTION

This invention relates to a connector, particularly, to a connector which is provided with a contact having an insulation-displacement connection portion.

A connector provided with a contact having an insulation-displacement connection (IDC) portion is known. The insulation-displacement connection portion is formed into a tuning fork shape and has two tines. Pushing a cable into a slit formed between the two tines allows a coating of a cable to be broken, and thereby a conductor of the cable can be connected to the contact without peel the coating. An example of a connector like this is disclosed in Japanese Unexamined Utility Model Application Publication No 1988-23775 (Patent Document 1).

As shown in FIGS. 21 and 22, in a connector disclosed in Patent Document 1, steps 911 and 913 are provided on inner edge portions of tines 901 and 903 of an insulation-displacement connection portion 90, respectively. In other words, the insulation-displacement connection portion 90 has a narrow slit 92 and a wide slit 94 which are different from each other in width. As shown in FIG. 21, the narrow slit 92 is used to be connected to a cable 95A which has a core wire with a relatively small diameter. Moreover, as shown in FIG. 22, the wide slit 94 is used to be connected to a cable 95B which has a core wire with a relatively large diameter. Thus, the connector of Patent Document 1 can be suitably connected to each of the cables 95A and 95B which have the core wires with the different diameters.

SUMMARY OF THE INVENTION

There is a case where a core wire which consists of a plurality of conductors, such as a twisted wire, is used as the core wire of the cable 95A. The connector 90 of Patent Document 1 has a problem that when the cable 95A having the core wire which consists of the plurality of the conductors is pushed into the narrow slit 92, some of the conductors forming the core wire might be cut.

It is an object of the present invention to provide a connector which is hard to cut conductors forming a core wire of a cable and has improved reliability of insulation-displacement connection.

One aspect of the present invention provides a connector comprising a contact and a housing which holds the contact. The contact is provided with an insulation-displacement connection portion to be connected to a cable. The insulation-displacement connection portion has two insulation-displacement blades and has a narrow slit and a wide slit. The insulation-displacement blades are different from each other in position in a first direction and correspond to the narrow slit. Each of the insulation-displacement blades intersects the first direction obliquely. Each of the narrow slit and the wide slit extends in the first direction. In a second direction perpendicular to the first direction, the narrow slit is smaller than the wide slit in size. In the first direction, one of the insulation-displacement blades is located between the narrow slit and the wide slit. In the second direction, a middle of the wide slit is different from a middle of the narrow slit in position.

In the insulation-displacement connection portion of the connector of the present invention, the two insulation-displacement blades corresponding to the narrow slit are different from each other in position in the first direction. Accordingly, when a cable is pushed into the narrow slit of the insulation-displacement connection portion, the cable is not pressed against the two insulation-displacement blades at the same time. Therefore, excessive cutting power is hard to be applied on a core wire of the cable, and possibility of the conductors being cut is reduced when the core wire consists of a plurality of conductors.

An appreciation of the objectives of the present invention and a more complete understanding of its structure may be had by studying the following description of the preferred embodiment and by referring to the accompanying drawings.

Figure 1:
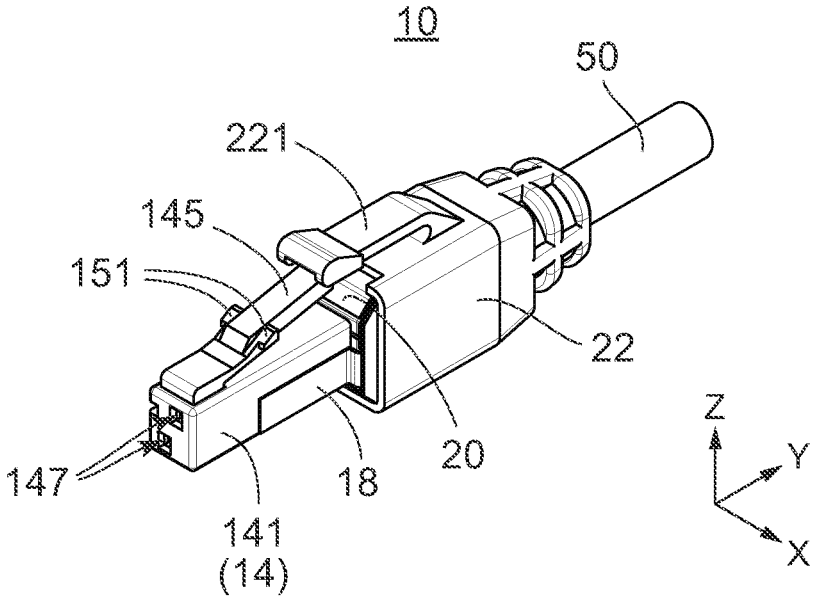
FIG. 1 is a perspective view showing a connector according to an embodiment of the present invention. The connector is attached to an end of a cable.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is an LC-type connector for a single pair Ethernet (SPE). The connector 10 is mateable with a mating connector (not shown) along a front-rear direction. In the present embodiment, the front-rear direction is a Y-direction. However, the present invention is not limited thereto. The present invention is applicable to any type of a connector having an insulation-displacement connection portion. The present invention is also applicable to not only a plug connector but a receptacle connector.

Figure 2:
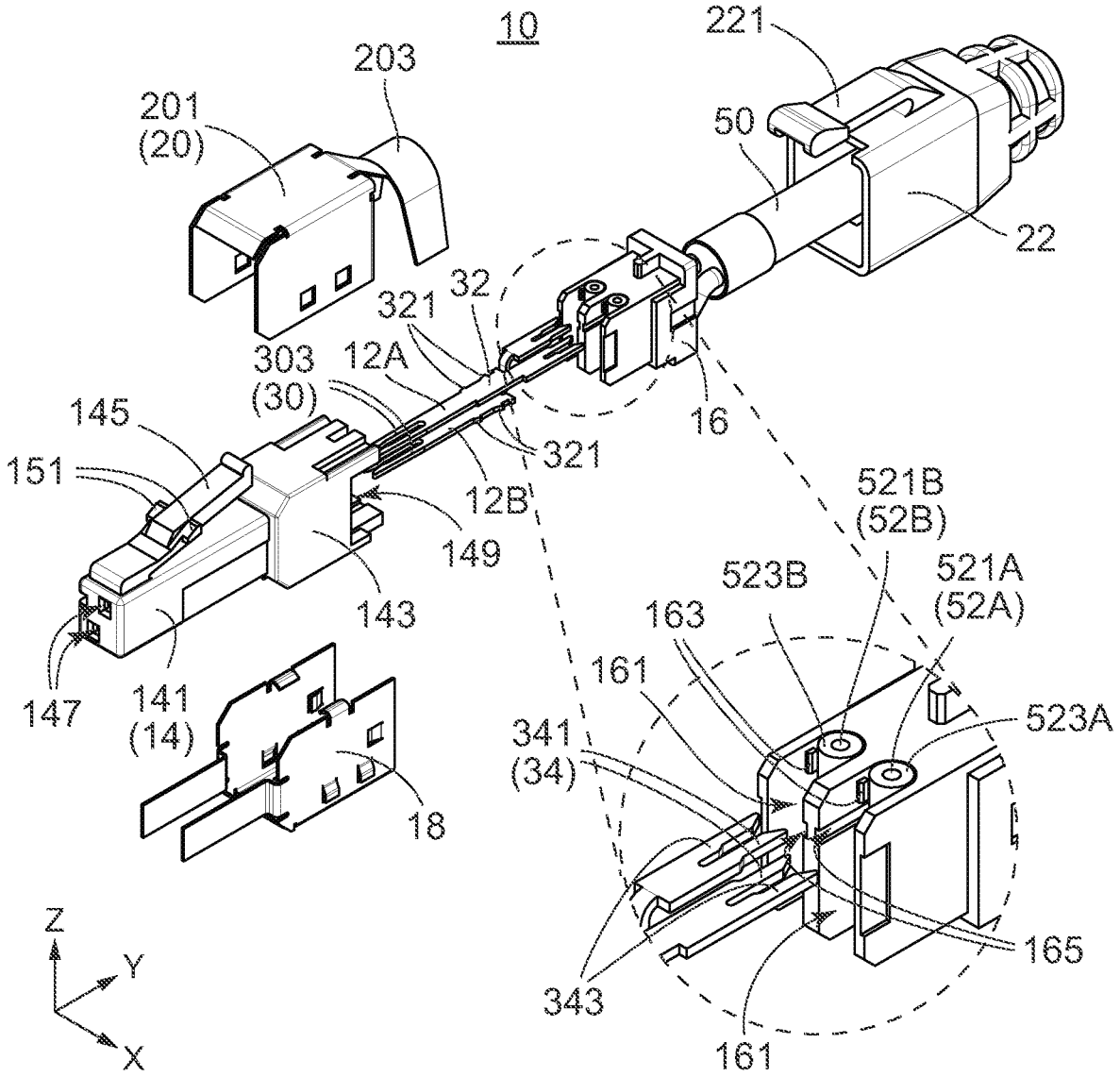
FIG. 2 is an exploded, perspective view showing the connector of FIG. 1. Insulation-displacement connection portions of first and second contacts and a part of a locator are shown in expanded fashion.

Referring to FIG. 2, the connector 10 according to the embodiment of the present invention is provided with a first contact 12A, a second contact (additional contact) 12B, a housing 14, a locator 16, a base shell 18, a cover shell 20 and a hood 22. However, the present invention is not limited thereto. The connector of the present invention may be modified, provide that it is provided with at least one contact and a housing holding the contact. Moreover, a shape and a size of each component are not limited but can be freely designed.

Figure 3:
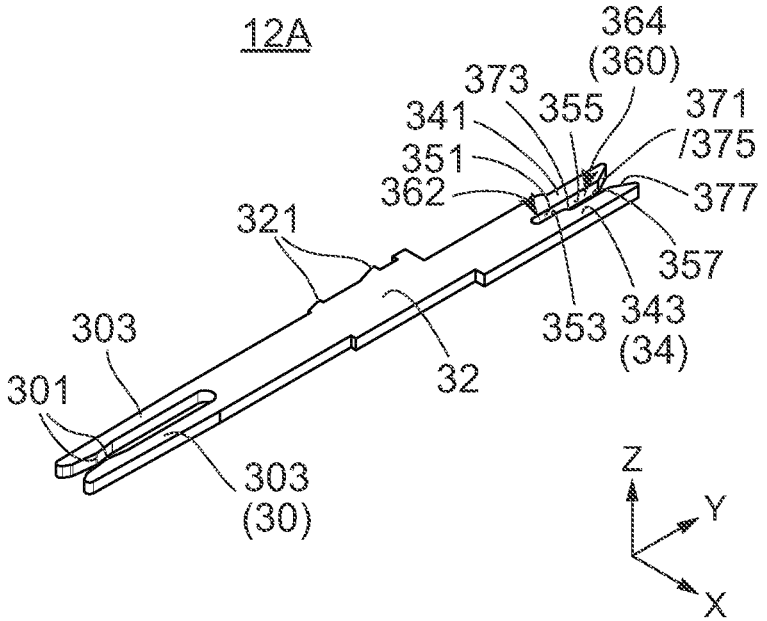
FIG. 3 is a perspective view showing the first contact included in the connector of FIG. 2.

As shown in FIG. 3, the first contact 12A has a contact portion 30, a held portion 32 and an insulation-displacement connection portion 34. The contact portion 30 is a part which is brought into contact with a mating contact portion (not shown) when the connector 10 (see FIG. 1) is mated with the mating connector (not shown). The held portion 32 is a part which is held by the housing 14 (see FIG. 2). The insulation-displacement connection portion 34 is a part which is used to be connected to a covered wire (cable) 52A included in a duplex cable 50 (see FIG. 2). The first contact 12A may be made by punching a metal sheet and has a long, narrow, flat shape extending in a front-rear direction (first direction).

Figure 4:
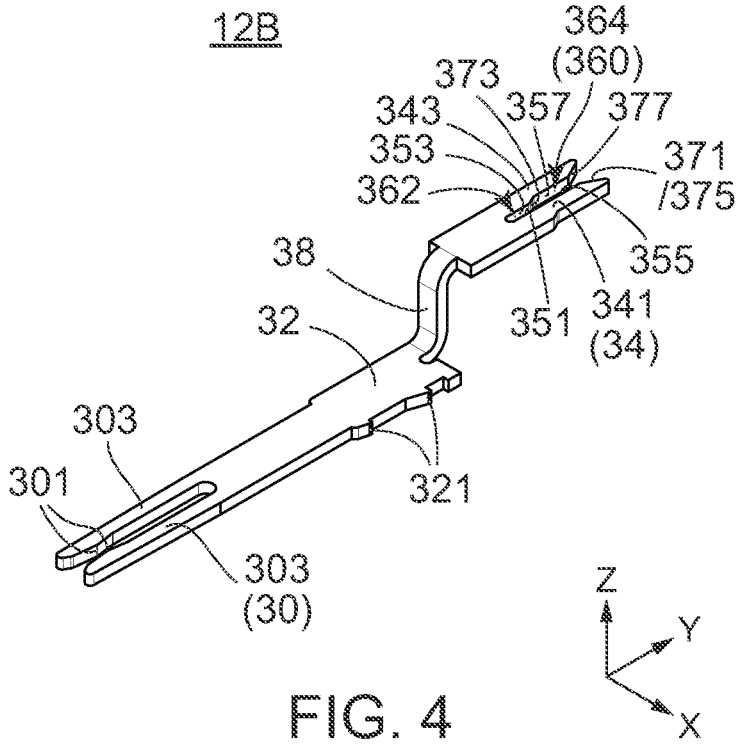
FIG. 4 is a perspective view showing the second contact included in the connector of FIG. 2.

As understood from FIGS. 3 and 4, the second contact 12B has a shape different from that of the first contact 12A. However, the present invention is not limited thereto. The second contact 12B may have the same shape as the first contact 12A.

As understood from FIGS. 3 and 4, the second contact 12B has a basic structure common to that of the first contact 12A. In other words, the second contact 12B also has a contact portion 30, a held portion 32 and an insulation-displacement connection portion (additional insulation-displacement connection portion) 34. In addition, the second contact 12B has a coupling portion 38 which couples the held portion 32 and the insulation-displacement connection portion 34 to each other. The coupling portion 38 extends in an up-down direction perpendicular to the front-rear direction. In the present embodiment, the up-down direction is a Z-direction. The second contact 12B may be made by stamping and bending a metal sheet.

Figure 5:
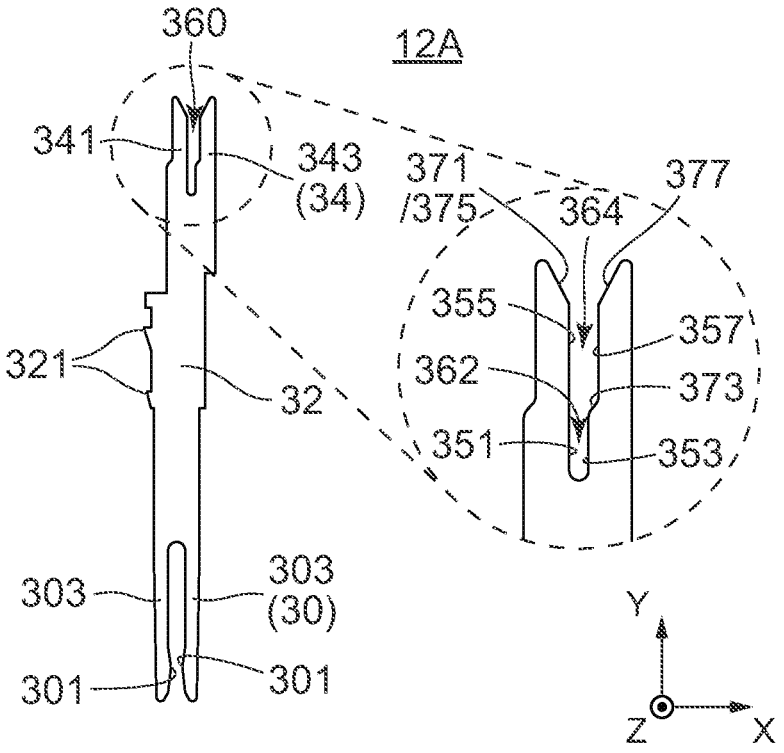
FIG. 5 is a plane view showing the first contact of FIG. 3. The insulation-displacement connection portion is shown in expanded fashion.
Figure 6:
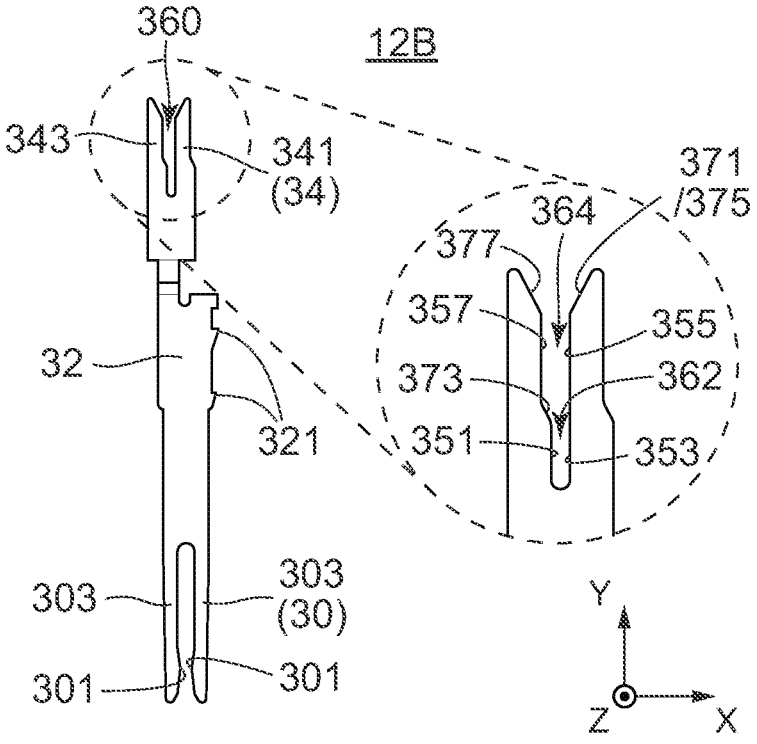
FIG. 6 is a plane view showing the second contact of FIG. 3. The insulation-displacement connection portion is shown in expanded fashion.

As understood from FIGS. 5 and 6, a shape of the contact portion 30 of the first contact 12A is the same as a shape of the contact portion 30 of the second contact 12B. Moreover, a shape of the held portion 32 of the first contact 12A and a shape of the insulation-displacement connection portion 34 of the first contact 12A are mirror images of a shape of the held portion 32 of the second contact 12B and a shape of the insulation-displacement connection portion 34 of the second contact 12B, respectively. The contact portion 30, the held portion 32 and the insulation-displacement connection portion 34 of the first contact 12A are substantially the same as the contact portion 30, the held portion 32 and the insulation-displacement connection portion 34 of the second contact 12B in function, respectively. Accordingly, the following description with respect to the first contact 12A holds true for the second contact 12B.

As shown in FIG. 5, the contact portion 30 of the first contact 12A has a pair of contact points 301 and supporting portions 303 which support the contact points 301, respectively. However, the present invention is not limited thereto. The shape of the contact portion 30 may be freely designed according to a shape of the mating contact portion (not shown).

As shown in FIG. 5, the held portion 32 of the first contact 12A has a plurality of protrusions 321 protruding in a lateral direction (second direction). In the present embodiment, the lateral direction is a direction perpendicular to both of the front-rear direction and the up-down direction, i.e., an X-direction. However, the present invention is not limited thereto. The protrusions 321 are not always necessary. The number and shapes of the protrusions 321 can be freely set. The held portion 32 may be modified, provided that it can be held by the housing 14.

As shown in FIG. 5, the insulation-displacement connection portion 34 of the first contact 12A is formed into a tuning fork shape and has two tines 341 and 343. Between the tines 341 and 343, a slit 360 extending in the front-rear direction is formed. The slit 360 has a narrow slit 362 and a wide slit 364. In other words, the insulation-displacement connection portion 34 has the narrow slit 362 and the wide slit 364.

As shown in FIG. 5, the narrow slit 362 is defined by an inner edge portion 351 of the tine 341 and an inner edge portion 353 of the tine 343. Moreover, the wide slit 364 is defined by an inner edge portion 355 of the tine 341 and an inner edge portion 357 of the tine 343. Each of the narrow slit 362 and the wide slit 364 extends in the front-rear direction. The narrow slit 362 and the wide slit 364 are contiguous to each other.

As understood from FIG. 5, in the lateral direction, a size of the narrow slit 362 is smaller than that of the wide slit 364. Moreover, in the lateral direction, a middle of the narrow slit 362 is different from that of the wide slit 364 in position. In the present embodiment, the inner edge portion 351 and the inner edge portion 355 are the same position in the lateral direction, and the inner edge portion 353 and the inner edge portion 357 are different from each other in position in the lateral direction. With this structure, in the lateral direction, the middle of the narrow slit 362 is located inward of the middle of the wide slit 364.

As shown in FIG. 5, the insulation-displacement connection portion 34 of the first contact 12A has two insulation-displacement blades 371 and 373. The insulation-displacement blades 371 and 373 correspond to the narrow slit 362. In other words, an end of the insulation-displacement blade 371 is on an extension of the inner edge portion 351 defining the narrow slit 362, and an end of the insulation-displacement blade 373 is on an extension of the inner edge portion 353 defining the narrow slit 362.

As shown in FIG. 5, the insulation-displacement blades 371 and 373 are different from each other in position in the front-rear direction. The insulation-displacement blade 373 is between the narrow slit 362 and the wide slit 364 in the front-rear direction. Moreover, the insulation-displacement blades 371 and 373 are obliquely intersected with the front-rear direction. In detail, the insulation-displacement blades 371 and 373 are directed rearward in the front-rear direction and inclined inward in the lateral direction.

As shown in FIG. 5, the insulation-displacement connection portion 34 of the first contact 12A further has two insulation-displacement blades (additional insulation-displacement blades) 375 and 377 corresponding to the wide slit 364. An end of the insulation-displacement blade 375 is on an extension of the inner edge portion 355 defining the wide slit 364, and an end of the insulation-displacement blade 377 is on an extension of the inner edge portion 357 defining the wide slit 364. Moreover, the insulation-displacement blades 375 and 377 are obliquely intersected with the front-rear direction. In detail, the insulation-displacement blades 375 and 377 are directed rearward in the front-rear direction and inclined inward in the lateral direction. In the present embodiment, the insulation-displacement blade 375 also serves as the insulation-displacement blade 371. However, the present invention is not limited thereto. The two insulation-displacement blades (additional insulation-displacement blades) 375 and 377 corresponding to the wide slit 364 may be provided in addition to the two insulation-displacement blades 371 and 373 corresponding to the narrow slit 362. Moreover, the first contact 12A may not have the insulation-displacement blades 375 and 377 corresponding to the wide slit 364.

Figure 7:
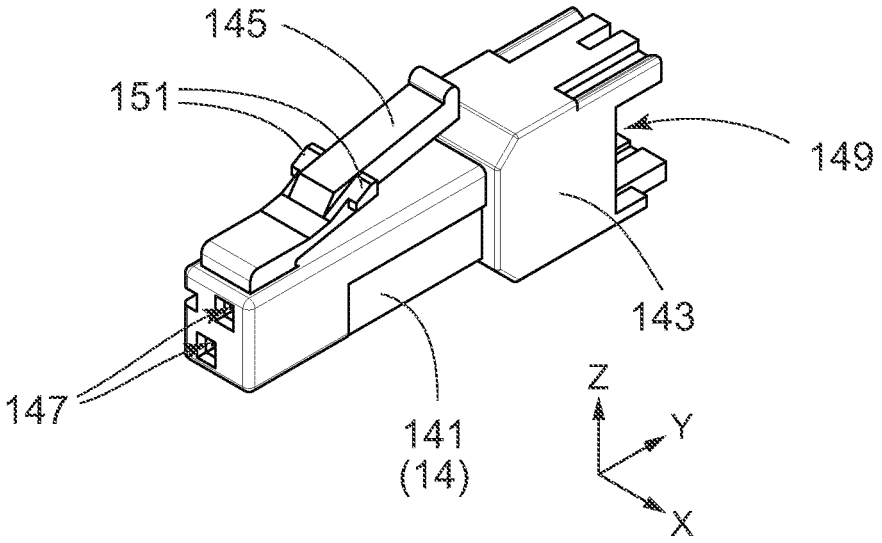
FIG. 7 is a perspective view showing a housing included in the connector of FIG. 2. The housing holds the first contact and the second contact, but the first contact and the second contact cannot be seen.

Referring to FIG. 7, the housing 14 is provided with a front portion 141, a rear portion 143 and lock-release lever 145. The housing 14 may be made of insulation resin.

As shown in FIG. 7, the front portion 141 of the housing 14 has an approximately rectangular parallelepiped shape long in the front-rear direction. In a front surface of the front portion 141, opening portions 147 are provided. The rear portion 143 is located rearward of the front portion 141 in the front-rear direction. The rear portion 143 defines a receiving portion 149 which opens rearward. In the front-rear direction, a size of the rear portion 143 is smaller than that of the front portion 141. In each of the up-down direction and the lateral direction, a size of the rear portion 143 is larger than that of the front portion 141. The lock-release lever 145 is provided on the front portion 141. The lock-release lever 145 extends rearward-diagonally upward. The lock-release lever 145 is provided with locking portions 151 which protrude in both sides in the lateral direction.

Figure 8:
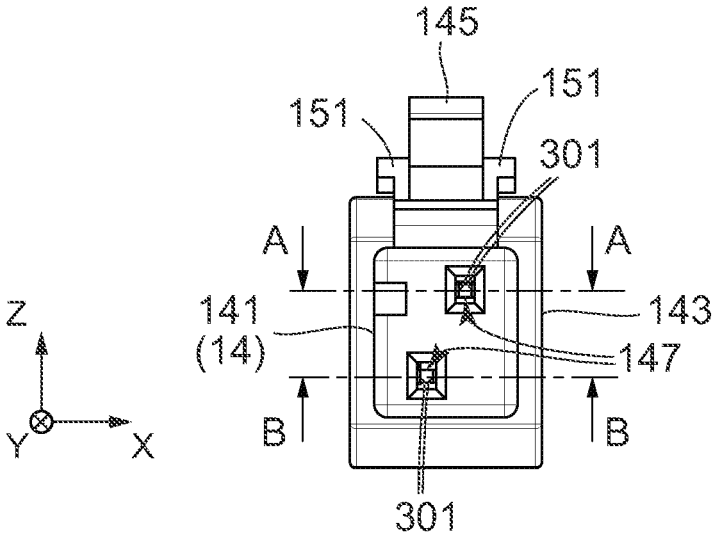
FIG. 8 is a front view showing the housing of FIG. 7.
Figure 9:
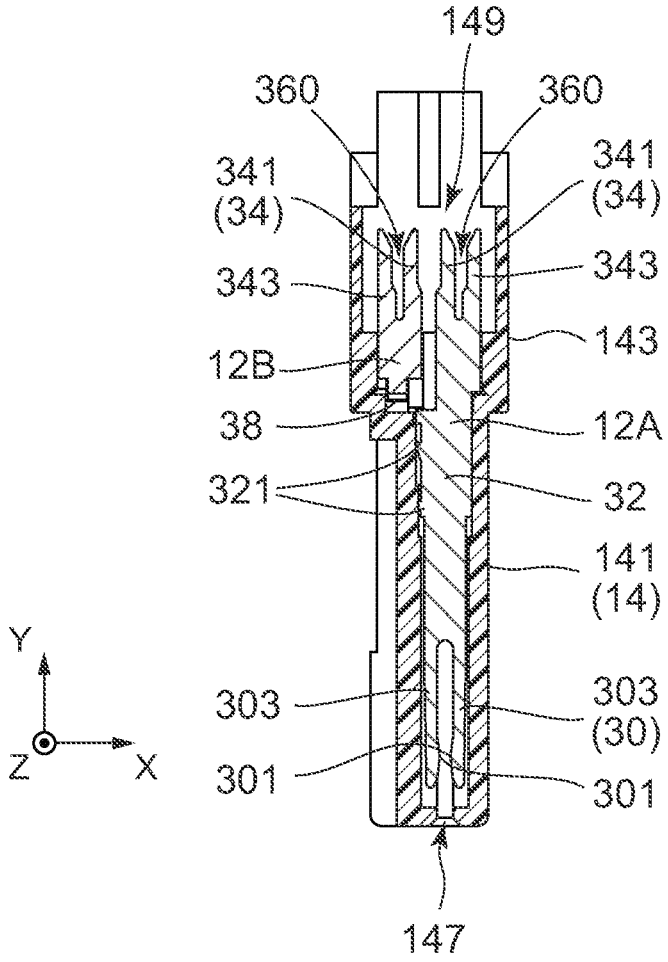
FIG. 9 is a cross-sectional view showing the housing of FIG. 8, taken along line A-A.
Figure 10:
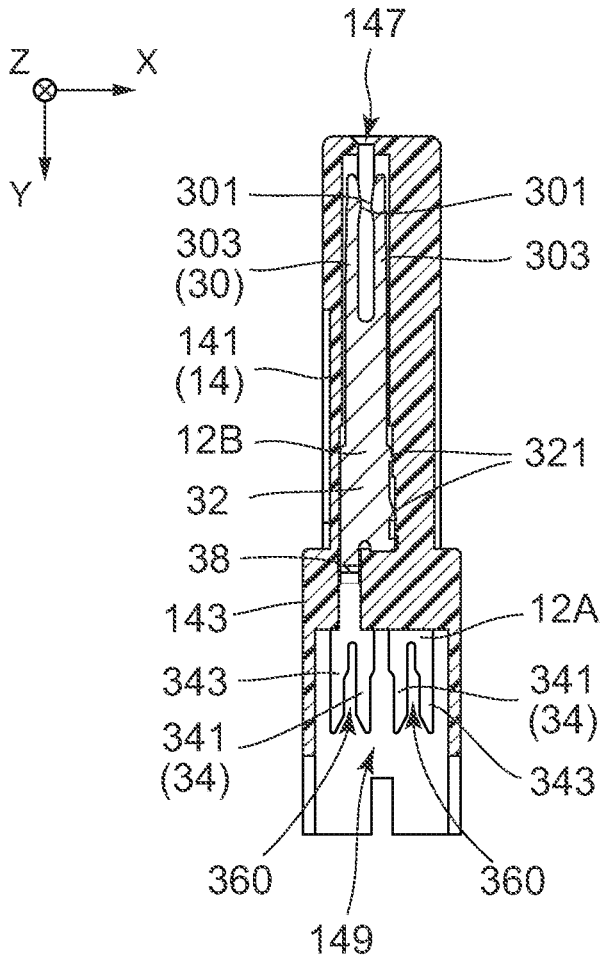
FIG. 10 is a cross-sectional view showing the housing of FIG. 8, taken along line B-B.

As understood from FIGS. 8 to 10, the housing 14 holds the first contact 12A and the second contact 12B. In detail, the housing 14 holds the held portion 32 of the first contact 12A and the held portion 32 of the second contact 12B. In the present embodiment, each of the first contact 12A and the second contact 12B is pressed into the housing 14 from behind in the front-rear direction. However, the present invention is not limited thereto. The housing 14 may be formed integrally with the first contact 12A and the second contact 12B.

As shown in FIGS. 9 and 10, the insulation-displacement connection portion 34 of the first contact 12A and the insulation-displacement connection portion 34 of the second contact 12B are located in the receiving portion 149 of the housing 14 at least in part so that the slits 360 of the first contact 12A and the slit 360 of the second contact 12B are located in the receiving portion 149. The insulation-displacement connection portion 34 of the first contact 12A and the insulation-displacement connection portion 34 of the second contact 12B are the same as each other in position in the front-rear direction. The insulation-displacement connection portion 34 of the first contact 12A and the insulation-displacement connection portion 34 of the second contact 12B are different from each other in position in the lateral direction. With respect to a plane which is perpendicular to the lateral direction and located between the insulation-displacement connection portion 34 of the first contact 12A and the second contact 12B, the insulation-displacement connection portion 34 of the first contact 12A and the insulation-displacement connection portion 34 of the second contact 12B are mirror images of each other.

Figure 11:
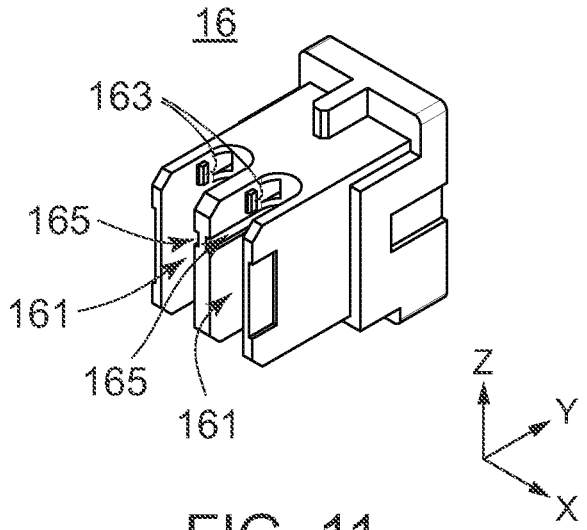
FIG. 11 is a perspective view showing the locator included in the connector of FIG. 2.

Referring to FIG. 11, the locator 16 has an approximately rectangular parallelepiped shape. The locator 16 is formed to be insertable into the receiving portion 149 of the housing 14 in part. The locator 16 may be made of insulation resin. The locator 16 is provided with locating grooves 161 and 161 which receive ends of the covered wires 52A and 52B of the duplex cable 50.

Figure 12:
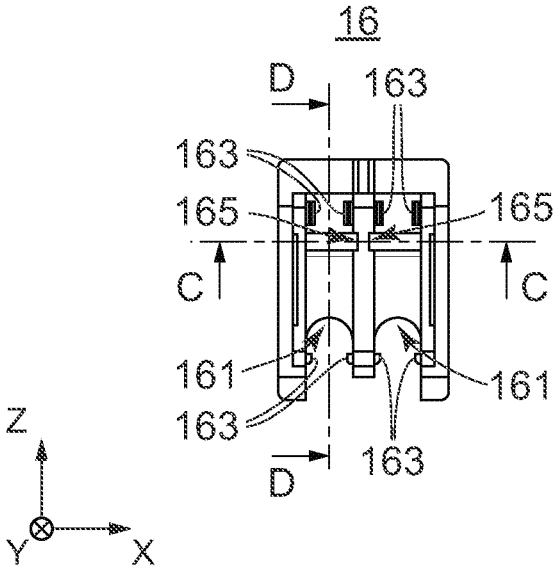
FIG. 12 is a front view showing the locator of FIG. 11.
Figure 13:
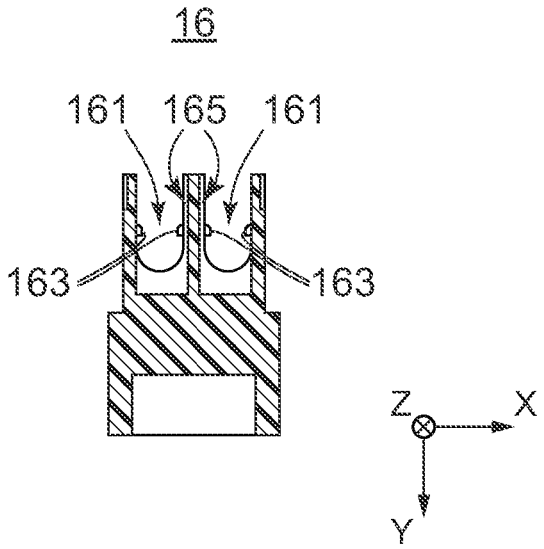
FIG. 13 is a cross-sectional view showing the locator of FIG. 12, taken along line C-C.
Figure 14:
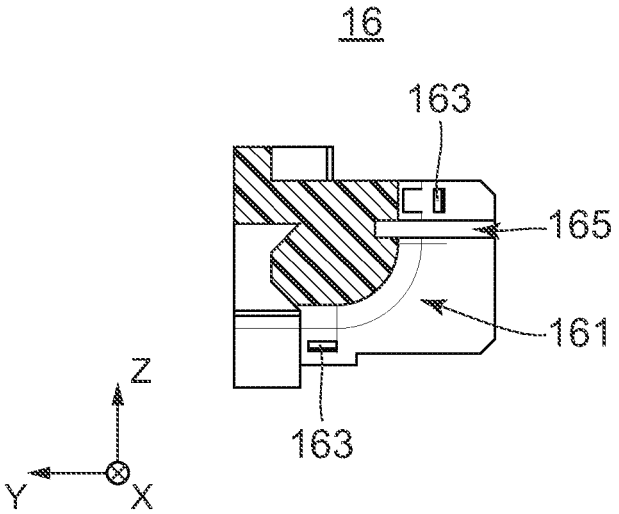
FIG. 14 is a cross-sectional view showing the locator of FIG. 12, taken along line D-D.

As understood from FIGS. 12 to 14, each of the locating grooves 161 and 161 opens downward in the up-down direction and forward in the front-rear direction. A position and a size of the locating groove 161 is decided according to a diameter of the covered wire (cable) 52A or 52B included in the duplex cable 50. Accordingly, the locating groove 161 of the locator 16 for a covered wire with a relatively large diameter is different from a locating groove 161A (see FIG. 20) of a locator 16A (see FIG. 20) for a covered wire with a relatively small diameter in position and in size. In the present embodiment, it should be noted that the covered wires 52A and 52B respectively have core wires 521A and 521 B each of which has the relatively large diameter, alternatively, the covered wires 52A and 52B respectively have core wires 521A and 521 B each of which has the relatively small diameter.

As shown in FIGS. 11 to 14, in an inner wall of each of the locating grooves 161 and 161, a plurality of holding protrusions 163 is formed to protrude into the locating groove 161. The holding protrusions 163 hold, in the locating groove 161, the end of the covered wire 52A or 52B of the duplex cable 50 received in the locating groove 161. However, the present invention is not limited thereto. The holding protrusions 163 are not always necessary, provided that each of the locating grooves 161 and 161 regulates movement of the covered wire 52A or 52B in the front-rear direction and in the lateral direction.

Figure 18:
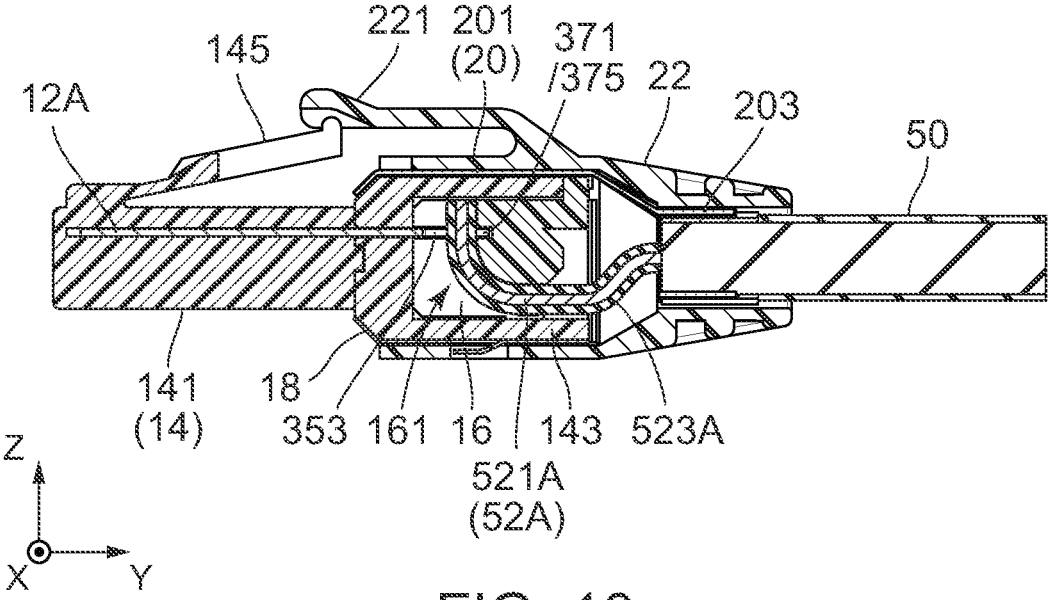
FIG. 18 is a cross-sectional view showing the connector of FIG. 15, taken along line F-F. The covered wire(s) (cable(s)) has a relatively large diameter. The locator corresponds to the covered wires each of which has the relatively large diameter. The covered wires held by the locator are connected to the first and the second contacts, respectively, using the wide slots of the insulation-displacement connection portions of the first and the second contacts. However, the second contact and the covered wire connected thereto cannot be seen.
Figure 20:
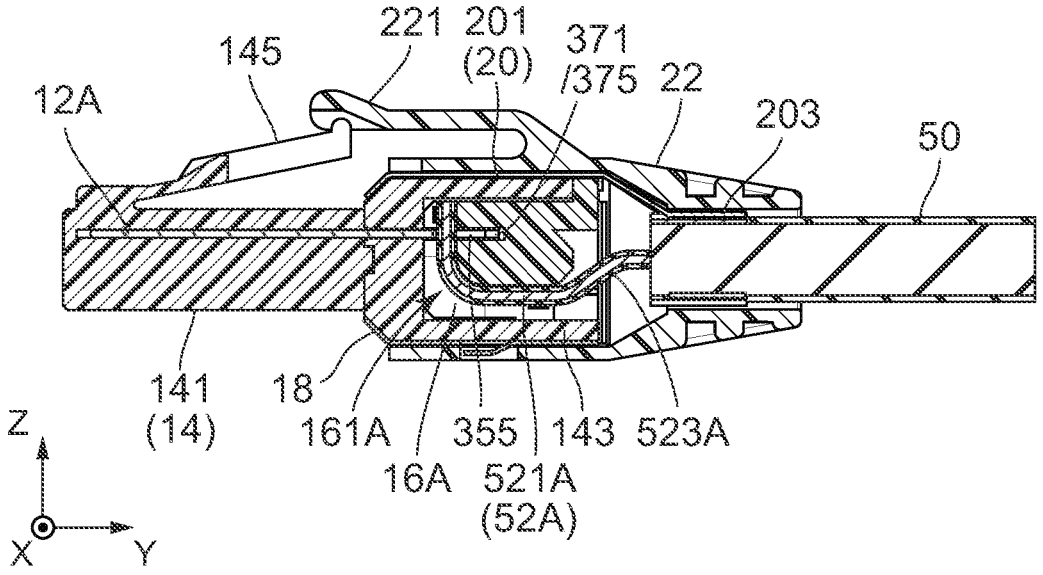
FIG. 20 is a cross-sectional view showing the connector of FIG. 15, taken along line F-F. The covered wire(s) (cable(s)) has a relatively small diameter. The locator corresponds to the covered wires each of which has the relatively small diameter. The covered wires held by the locator are connected to the first and the second contacts, respectively, using the narrow slots of the insulation-displacement connection portions of the first and the second contacts. However, the second contact and the covered wire connected thereto cannot be seen.
Figure 21:
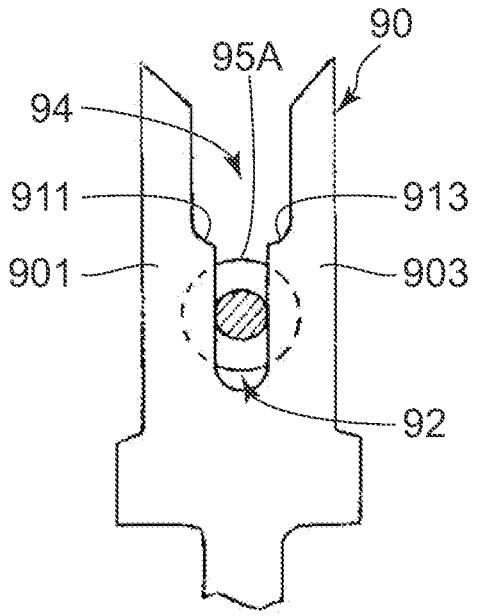
FIG. 21 PRIOR ART
FIG. 21 is a plane view showing an insulation-displacement connection portion disclosed in Patent Document 1. A cable is connected to the insulation-displacement connection portion using a narrow slit.
Figure 22:
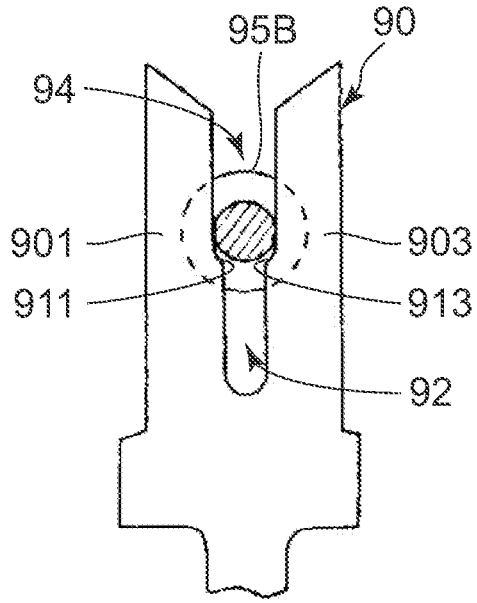
FIG. 22 PRIOR ART
FIG. 22 is another plane view showing the insulation-displacement connection portion of FIG. 21. A cable is connected to the insulation-displacement connection portion using a wide slit.

As understood from FIGS. 2, 18 and 20, the locator 16 or 16A holds the ends of the covered wires 52A and 52B to regulate movements of the covered wires 52A and 52B in the front-rear direction and in the lateral direction. Each of the ends of the covered wires 52A and 52B extends forward from behind the locator 16 or 16A, then extends upward. The locator 16 or 16A holds the ends of the covered wires 52A and 52B so that the covered wires 52A and 52B are perpendicular to the insulation-displacement connection portions 34 and 34. Thus, the locator 16 or 16A locates the covered wires 52A and 52B with respect to the housing 14 when the locator 16 or 16A is attached to the housing 14.

As shown in FIGS. 11, 13 and 14, in the inner wall of each of the locating grooves 161 and 161, a guide groove 165 is formed. In the present embodiment, the guiding groove 165 is provided in one of the inner walls of each of the locating grooves 161 and 161 in the lateral direction. In detail, the guiding groove 165 is provided in one of flat surfaces of the inner walls of each of the locating grooves 161 and 161, wherein the inner walls face each other in the second direction. The guiding groove 165 is recessed in the lateral direction and extends in the front-rear direction. The guiding groove 165 guides the insulation-displacement connection portion 34 of the first contact 12A or the second contact 12B, when the housing 14 and the locator 16 are combined with each other. However, the present invention is not limited thereto. The guiding groove 165 may be provided in each of the inner walls of the locating groove 161 in the second direction. In other words, the guiding groove 165 is provided in at least one of the inner walls of the locating groove 161 in the second direction.

Figure 15:
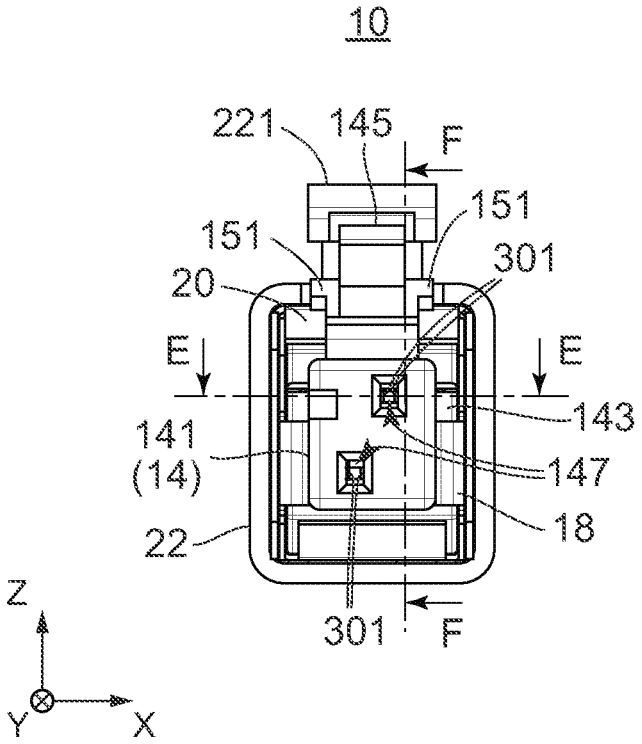
FIG. 15 is a front view showing the connector of FIG. 1.
Figure 16:
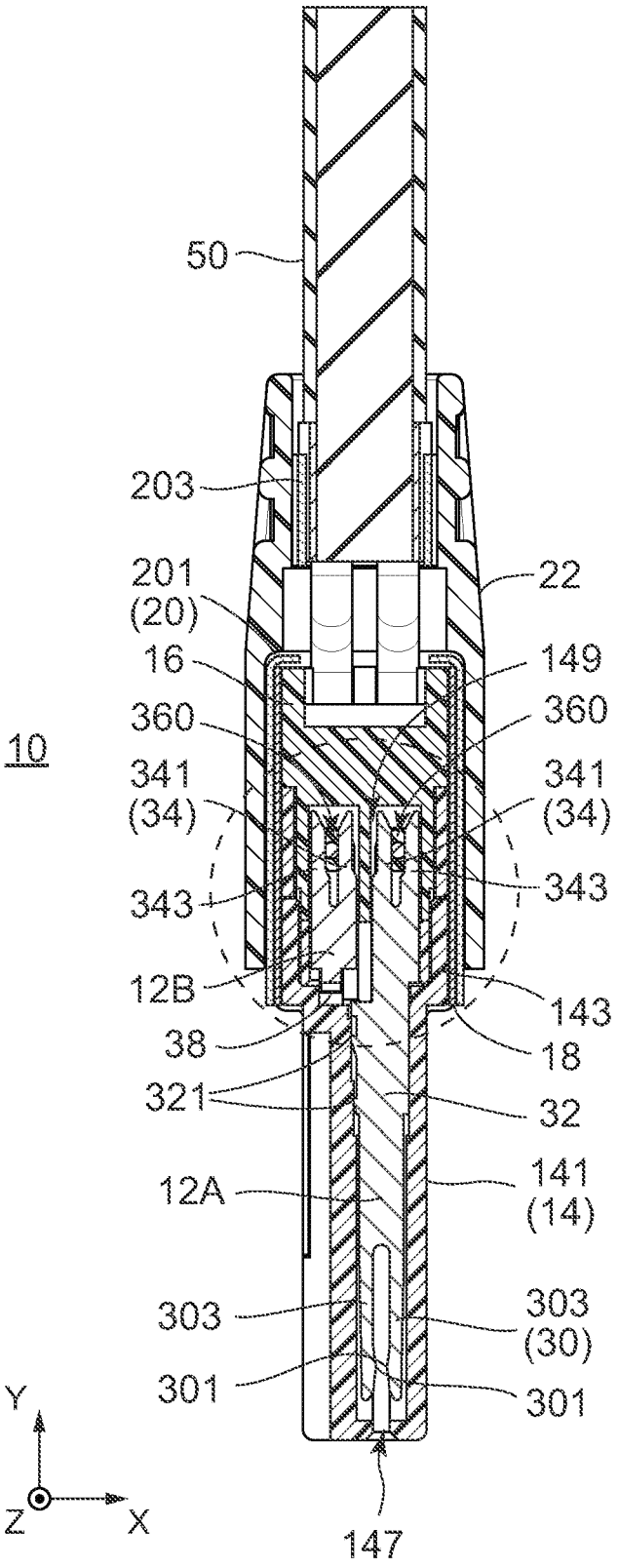
FIG. 16 is a cross-sectional view showing the connector of FIG. 15, taken along line E-E. Covered wires (cables) are connected to the first and the second contact, respectively, using wide slots of the insulation-displacement connection portions of the first and the second contacts.
Figure 17:
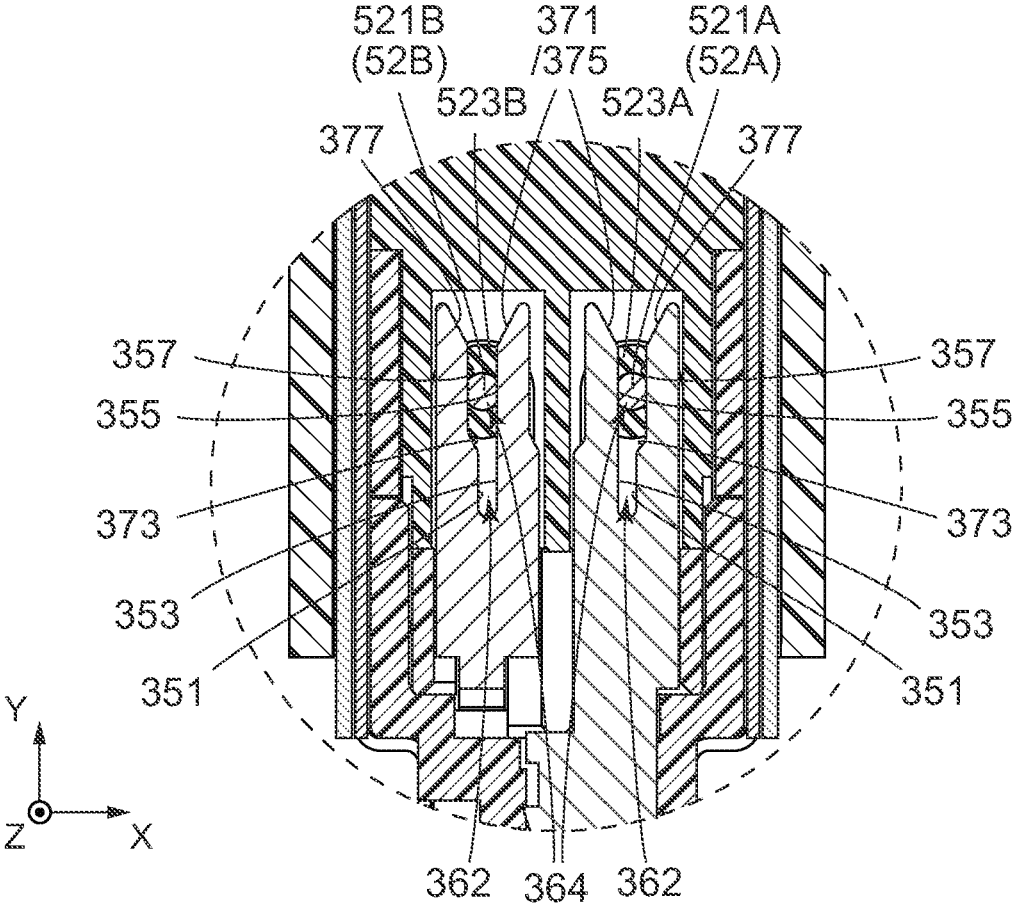
FIG. 17 is a partial, enlarged view showing a broken-line circled part of the connector of FIG. 16.

As understood from FIGS. 15 to 17, the locator 16 is received in the receiving portion 149 of the housing 14 in part to be attached to the housing 14. In the meantime, the insulation-displacement connection portion 34 of the first contact 12A and the insulation-displacement connection portion 34 of the second contact 12B are guided by the guiding grooves 165 and 165 and moved in the locating grooves 161 and 161, respectively. The insulation-displacement connection portion 34 of the first contact 12A and the insulation-displacement connection portion 34 of the second contact 12B are moved at a fixed angle with respect to the covered wires 52A and 52B held by the locator 16.

As understood from FIGS. 16 to 18, when the locator 16 is inserted into the receiving portion 149 of the housing 14, the covered wire 52A of the duplex cable 50 held by the locator 16 is pushed by the locator 16 and inserted into the slit 360 of the insulation-displacement connection portion 34 of the first contact 12A. Here, the locator 16 for holding the covered wire 52A with the relatively large diameter is formed so that the middle position of the locating groove 161 and the middle position of the wide slit 364 are identical to each other in the lateral direction. Accordingly, the covered wire 52A with the relatively large diameter is pressed on the insulation-displacement blades 375 and 377 approximately evenly. In the lateral direction, a size of the core wire 521A is slightly larger than that of the wide slit 364. As a result, when the covered wire 52A is pushed into the wide slit 364, a coating 523A is broken by the insulation-displacement blades 375 and 377. Then, the core wire 521A is inserted into the wide slit 364 and brought into contact with the inner edge portions 355 and 357. Thus, the insulation-displacement connection portion 34 of the first contact 12A is electrically connected to the covered wire 52A located by the locating groove 161 of the locator 16. In a similar fashion, the insulation-displacement connection portion 34 of the second contact 12B is electrically connected to the covered wire 52B with the relatively large diameter.

Figure 19:
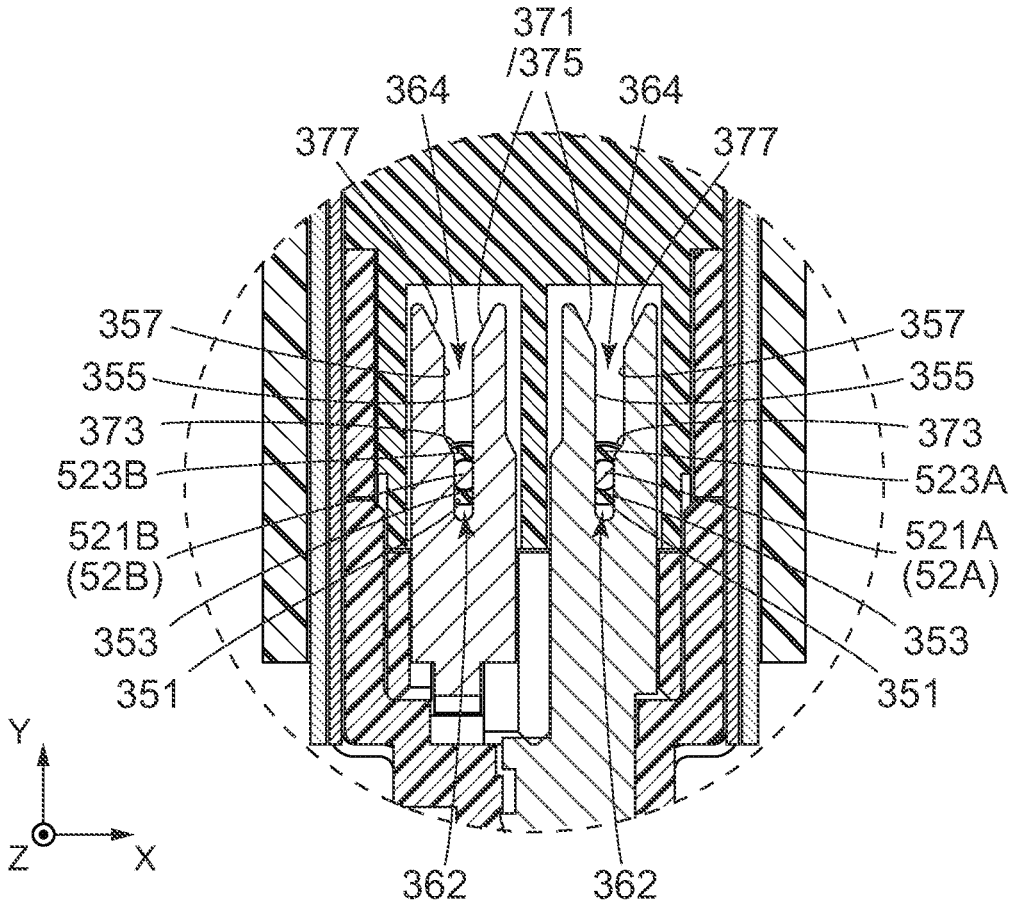
FIG. 19 is a partial, enlarged view showing a broken-line circled part of the connector of FIG. 16. Covered wires (cables) are connected to the first and the second contacts, respectively, using narrow slots of the insulation-displacement connection portions of the first and the second contacts.

As understood from FIGS. 16, 19 and 20, the locator 16A for holding the covered wire 52A with the relatively small diameter is formed so that the middle position of the locating groove 161A and the middle position of the narrow slit 362 are identical to each other in the lateral direction. Accordingly, the locator 16A for holding the covered wire 52A with the relatively small diameter is formed so that the middle position of the locating groove 161A and the middle position of the wide slit 364 are different from each other in position in the lateral direction. In this structure, when the locator 16A is received in the receiving portion 149 of the housing 14, the covered wire 52A held by the locator 16A is pressed relatively stronger on the insulation-displacement blade 371 than on the insulation-displacement blade 377. As a result, the covered wire 52A receives a force in a lateral direction that moves the core wire 521A away from the insulation-displacement blade 371. Although movement of the covered wire 52A in the lateral direction is regulated by the locator 16A, transformation of a sectional shape of the covered wire 52A is allowed. Accordingly, when the core wire 521A consists of a plurality of conductors, possibility of the conductors receiving a cut force is reduced. Then, the covered wire 52A is pressed on the insulation-displacement blade 373. The covered wire 52A is pressed on the insulation-displacement blade 371 and the insulation-displacement blade 373 in order, and thereby the coating 523A is broken. As a result, upon entering the narrow slit 362, the core wire 521A is brought into contact with the inner edge portions 351 and 353. Thus, the insulation-displacement connection portion 34 of the first contact 12A is electrically connected to the covered wire 52A located by the locating groove 161A of the locator 16A. In a similar fashion, the insulation-displacement connection portion 34 of the second contact 12B is electrically connected to the covered wire 52B with the relatively small diameter.

As shown in FIGS. 17 and 19, since the middle of the narrow slit 362 is located inward of the middle of the wide slit 364 in the lateral direction, a distance between the covered wires 52A and 52B which are connected to the connector 10 and each of which has the relatively small diameter is smaller than a distance between the covered wires 52A and 52B which are connected to the connector 10 and each of which has the relatively large diameter. In other words, according to the present embodiment, the distance between the covered wires 52A and 52B is changed according to the diameter of each of the covered wires 52A and 52B, and thereby a differential impedance between the covered wires 52A and 52B can be properly maintained.

As understood from FIG. 2, the base shell 18 is formed to have a squared U-shape when viewed along the front-rear direction. The base shell 18 may be made by stamping and bending a metal sheet. As shown in FIGS. 18 and 20, the base shell 18 covers the rear portion 143 of the housing 14 and the locator 16 or 16A from beneath. Moreover, as shown in FIG. 16, the base shell 18 covers the rear portion 143 of the housing 14 and the locator 16 from both sides in the lateral direction.

As shown in FIG. 2, the cover shell 20 has a main portion 201 and a barrel portion 203. The main portion 201 is formed to have a squared inverted U-shape when viewed along the front-rear direction. The cover shell 20 may be made by stamping and bending a metal sheet. As shown in FIGS. 18 and 20, the main portion 201 of the cover shell 20 covers the rear portion 143 of the housing 14 and the locator 16 or 16A from above. Moreover, as shown in FIG. 16, the cover shell 20 covers the rear portion 143 of the housing 14 and the locator 16 from both sides in the lateral direction. As understood from FIGS. 16, 18 and 20, the barrel portion 203 of the cover shell 20 is fixed to the duplex cable 50.

As understood from FIGS. 2, 16, 18 and 20, the hood 22 is attached to the duplex cable 50 to cover the base shell 18 and the cover shell 20. As shown in FIGS. 18 and 20, the hood 22 is provided with an operation portion 221 extending forward. A front-end portion of the operation portion 221 covers a rear-end portion of the lock-release lever 145 from above. The hood 22 may be made of insulation resin. Upon moving the front-end portion of the operation portion 221 downward in the up-down direction, the operation portion 221 is brought into abutment with the rear-end portion of the lock-release lever 145 to deform the lock-release lever 145 resiliently. Accordingly, the locking portion 151 (see FIG. 1) is moved downward in the up-down direction.

Although the specific explanation about the present invention is made above referring to the embodiments, the present invention is not limited thereto but susceptible of various modifications and alternative forms without departing from the spirit of the invention. For example, although the insulation-displacement connection portion 34 extends in the front-rear direction identical to the mating direction in the aforementioned embodiment, the insulation-displacement connection portion 34 may extend in a direction different from the mating direction. In other words, the first direction in the present invention may be a direction different from the mating direction.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector comprising a contact and a housing which holds the contact, wherein:

the contact is provided with an insulation-displacement connection portion to be connected to a cable;

the insulation-displacement connection portion has two insulation-displacement blades and has a narrow slit and a wide slit;

the insulation-displacement blades are different from each other in position in a first direction and correspond to the narrow slit;

each of the insulation-displacement blades intersects the first direction obliquely;

each of the narrow slit and the wide slit extends in the first direction;

in a second direction perpendicular to the first direction, the narrow slit is smaller than the wide slit in size;

in the first direction, one of the insulation-displacement blades is located between the narrow slit and the wide slit; and in the second direction, a middle of the wide slit is different from a middle of the narrow slit in position.

2. The connector as recited in claim 1, wherein:

the insulation-displacement connection portion further has two additional insulation-displacement blades correspond to the wide slit; and one of the additional insulation-displacement blades also serves as one of the insulation-displacement blades correspond to the narrow slit.

3. The connector as recited in claim 1, wherein:

the connector further comprises a locator which locates the cable;

the locator is formed with a locating groove which regulates movement of the cable in both of the first direction and the second direction to locate the cable;

the insulation-displacement connection portion is to be connected to the cable located by the locating groove; and in the second direction, a middle of the locating groove is different from the middle of the wide slit in position.

4. The connector as recited in claim 3, wherein, in the second direction, the middle of the locating groove is identical with the middle of the narrow slit.

5. The connector as claimed in claim 3, wherein:

the locator is formed with a guiding groove into which the insulation-displacement connection portion is inserted;

the guiding groove is provided in at least one of inner walls of the locating groove in the second direction; and the guiding groove is recessed in the second direction and extends in the first direction.

6. The connector as recited in claim 1, wherein:

the connector further comprises an additional contact;

the additional contact is provided with an additional insulation-displacement connection portion having a shape which is a mirror image of a shape of the insulation-displacement connection portion;

in the first direction, the insulation-displacement connection portion is identical to the additional insulation-displacement connection portion in position; and in the second direction, the insulation-displacement connection portion is different from the additional insulation-displacement connection portion in position.

* * * * *